United States Patent [19]

Nishimura et al.

[11] 4,363,678

[45] Dec. 14, 1982

[54] EXPLOSIVES HAVING POWDERED FERRITE MAGNET AS A TRACER DISPERSED THERETHROUGH AND A METHOD FOR PRODUCING THE SAME

[75] Inventors: Naozumi Nishimura, Sendai; Akira Matsunaga, Yokohama; Yasuo Ishii, Yotsukaido, all of Japan

[73] Assignee: Tohoku Metal Industries, Tokyo, Japan

[21] Appl. No.: 217,231

[22] Filed: Dec. 17, 1980

[51] Int. Cl.[3] ..... C06B 45/32

[52] U.S. Cl. ..... 149/6; 149/109.6; 149/110; 264/3 C

[58] Field of Search ..... 149/2 T, 6, 109.6, 110; 264/3 C

[56] References Cited

U.S. PATENT DOCUMENTS 3,110,638 11/1963 Murphy et al. ..... 149/6

*Primary Examiner*—Stephen J. Lechert, Jr.

*Attorney, Agent, or Firm*—Posnack, Roberts, Cohen & Spiecens

[57] ABSTRACT

An explosive having a relatively small amount of powdered ferrite magnet dispersed therethrough, each magnet particle coated with a resin coating which is stable for the explosive material on the entire outer surface thereof. The resultant explosive is readily detected by a magnetic detector and is stable for a long time storage. As the resin coating, methyl methacrylate resin, styrene resin, acrylonitril resin, butadiene resin, vinyl acetate resin, acrylic acid resin, methylacrylate resin and/or the other vinyl resin is used.

The resin coating is colored to color the explosives so that explosives may be distinctly visible, readily detected and identified.

14 Claims, No Drawings

EXPLOSIVES HAVING POWDERED FERRITE MAGNET AS A TRACER DISPERSED THERETHROUGH AND A METHOD FOR PRODUCING THE SAME

BACKGROUND OF THE INVENTION

This invention relates to explosives having powdered ferrite magnet, or megnetized ferrite powder, as a tracer and a method for producing the same, and in particular, to improvements of powdered ferrite magnet dispersed in explosives.

In a Japanese patent application No. 45,858/'75 filed on Apr. 17, 1975 which was laid open for public inspection on Oct. 23, 1976 under No. 121,507/'76, two of three joint inventors of this invention, Ishii and Matsunaga, proposed, together with other joint inventor, an explosive in which powdered magnet is mixed and dispersed as a tracer.

Because the explosive having the powdered magnet can be detected by use of a magnetic detector, detection of a misfired explosive remained in the blasting hole or mixed with a muck, detection of a lost explosive, detection of illegal possession of an explosive, and detection of theft of an explosive cann be readily effected.

In case ferrite magnet is used as the powdered magnet dispersed in the explosive, it was found out that the explosive was subjected to chemical change during a storage. For example, the heat resistance of an ammonia gelatine dynamite (Enoki No. 2 dynamite) having the ferrite powder was measured 8–9 minutes according to Abel heat test. It was estimated that such a chemical change of the explosive was caused due to the existence of a certain alkaline material as a impurity in the powdered ferrite magnet. The alkaline material reacts on nitroglycerine, nitroglycol and/or nitrocellulose and accelerates decomposition of these ingredients of the explosive, so that the stability of the explosive may be degraded.

SUMMARY OF THE INVENTION

Accordingly, it is a main object of this invention to provide an improved explosive having powdered ferrite magnet dispersed therethrough.

It is another object of this invention to provide an explosive having powdered ferrite magnet each particle of which is coated with a resin film for preventing any alkaline material included in the powdered magnet to be contact with explosive materials surrounding each magnet particle.

It is still another object of this invention to provide an explosive having powdered ferrite magnet which is colored to be distinctly visible so that detection of the explosive may be readily effected visually.

It is yet another object of this invention to provide explosives having powdered ferrite magnet which are distinctly distinguishable from one another to enable judgemene of origin of them and later identification of respective explosives.

It is another object of this invention to provide powdered ferrite which is adaptable for realizing above mentioned objects.

It is still another object of this invention to provide a method for producing an explosive having powdered ferrite magnet dispersed therethrough.

This invention provides an explosive having podered ferrite magnet dispersed therethrough wherein each particle of the powdered ferrite magnet is coated with a coating which is stable for explosive materials.

According to an aspect of this invention, the kind and the amount of the mixed powdered ferrite magnet are properly predetermined to be different between different explosives, to thereby enable later identification of respective explosives.

According to another aspect of this innvention, the coating of each particle of the powdered ferrite magnet includes a coloring agent to thereby color the explosive in which the powdered ferrite magnet is mixed, so that the explosive may be distinctly visible. Judgement of origin of explosives and later identification are also possible.

As powdered ferrite magnet, barium ferrite magnet, strontium ferrite magnet, lead ferrite magnet, and calcium ferrite magnet are used alone or combined.

As material of the coating of each ferrite paticle, methyl methacrylate resin, styrene resin, acrylonitril resin, butadiene resin, vinyl acetate resin, acrylic acid resin, methyl acrylate resin, and other vinyl resin whih is stable for explosive material can be used.

The explosive having powdered ferrite powder and subjecting the powder to a coating treatment with at least one of the above described coating materials. The coated ferrite powder is mixed with explosive material and kneaded by a kneader. The mixture is formed in a desired shape and then, wrapping paper or waxed paper to form an explosive cartridge. The cartridge is loaded in a magnetizing machine to magnetize the resin coated ferrite powder mixed in the explosive.

Further objects, features and other aspects of this invention will be understood from the following detailed description of preferred embodiments of this invention.

DETAILED DESCRIPTION OF PREFERRED EMBODIMENTS

Ferrite used in this invention is produced by processes well known in the art. Barium carbonate ($BaCO_3$) and ferric oxide ($Fe_2O_3$) are mixed at a molar ratio of 1/2.8–1/6, and are baked at a temperature of 900°–1250° C. Thus, barium ferrite is obtained.

When strontium carbonate ($SrCO_3$), lead oxide (PbO) or calcium carbonate ($CaCO_3$) is used in place of barium carbonate, strontium ferrite, lead ferrite or calcium ferrite can be produced.

The obtained ferrite is milled by a known milling machine to have a predetermined particle size. The mean particle diameter is predetermined to be 100 μm or less, considering that each particle scattered by blasting should not be detected by its residual magnetization and that a kneading machine which is used for kneading and mixing the ferrite powder and the explosive material is substantially free from wearing at a time when they are kneaded.

The resultant ferrite powder is subjected to a coating treatment to coat each particle with a coating which is stable for explosive materials. The ferrite powder is put into a resin forming monomer solution. Methylmethacrylate, styrene, acrylonitrile, butadiene, vinyl acetate, acrylic acid, methyl acrylate or other vinyl monomer is used as the monomer. The monomer is subjected to polymerization to form a polymer coating on the outer surface of each ferrite particle. The ferrite powder is, thereafter, filtrated, cleansed by water and dried. Thus, ferrite powder coated with the polymer is obtained.

The polymer-coated ferrite powder is mixed with explosive material and kneaded by a kneader. The mixture is formed in a desired shape and then, wrapped by wrapping paper, or waxed paper, to form explosive cartridge. The cartridge is loaded in a magnetizing machie to magnetize ferrite powder mixed in the explosive. Thus, the explosive having powdered ferrite magnet is obtained.

The amount of the polymer coated ferrite powder which is mixed with explosive material, is 30 wt.% or less, advantageously 20 wt.% or less, to prevent deterioration of specific characteristic of the explosive.

The explosive of this invention according to the above described processes is detectable by use of a magnetic detector, similar to explosives disclosed in the above described Japanese patent application, but the explosive of this invention is stable for a long time storage.

It will be noted that explosives may be brought into a long time storage before magnetization of the dispersed ferrite powder. In the case, magnetization is effected when use of explosives is required.

There is a heat resistant test to estimate the stability of explosives. It was ascertained by the heat resistant test according to Abel heat test, which is well known in the art, that the explosive having either magnetized ferrite owder or non-magnetized ferrite powder according to this invention was stable.

EXAMPLE 1

Barium ferrite powder of 100 grams and water of 500 grams were inserted in a flask of 1 l, and were stirred during a half hour at 60° C. Then, methylmethacrylate monomer of 4 grams and 6% sulfurous acid of 20 grams were added in the flask, and then stirred during 2 hours at 60° C. to polymerize the monomer. A polymer coating was formed on the surface of each ferrite particle. The ferrite powder was, thereafter, filtrated, cleansed by water of 70° C. and dried at 100° C. Thus, ferrite powder coated with 3 wt.% polymethyl methacrylate was obtained. The resin coated ferrite powder of 10 wt.% was mixed with ammonia gelatine dynamite (Enoki No. 2 dynamite) of the balance to form an explosive cartridge. The resultant cartridge was subjected to Abel heat test. The heat test was performed to a cartridge subjected to a magnetization process and a non-magnetized cartridge. The heat resistance of 20 minutes or longer was measured in each cartridge. This value is compared with the heat resistance of 8–9 minutes of a dynamite having non-coated powdered ferrite.

EXAMPLE 2

Using vinyl acetate, styrene, methyl acrylate, acrylonitrile, butadiene and acrylic acid as monomers, ferrite powders coated with, vinyl acetate resin of 3.0 wt.% for 100 wt.% ferrite, styrene resin of 2.6 wt.% for 100 wt.% ferrite, methyl acrylate resin of 2.4 wt.% for 100 wt.% ferrite, acrylonitrile resin of 2.3 wt.% for 100 wt.% ferrite, butadiene resin of 2.5 wt.% for 100 wt.% ferrite, and acrylic acid resin of 2.4 wt.% for 100 wt.% ferrite were prepared, respectively. The heat resistances of ammonia gelatine dynamites (Enoki No. 2 dynamites) including these resin-coated powdered ferrite magnets were measured as shown in the following Table 1.

TABLE 1

| Example number of dynamite | Amount of resin coated ferrite in dynamite | Used resin Amount for 100 wt. % ferrite | Heat resistance measured |
|---|---|---|---|
| 1 | 10 wt. % | Vinyl acetate resin 3.0 wt. % | Longer than 20 min. |
| 2 | 10 wt. % | Styrene resin 2.6 wt. % | Longer than 20 min. |
| 3 | 10 wt. % | Methyl acrylate resin 2.4 wt. % | Longer than 20 min. |
| 4 | 10 wt. % | Acrylonitril resin 2.3 wt. % | Longer than 20 min. |
| 5 | 10 wt. % | Butadiene resin 2.5 wt. % | Longer than 20 min. |
| 6 | 10 wt. % | Acrylic acid resin 2.4 wt. % | Longer than 20 min. |

It will be easily understood that, if the kind and/or amount of ferrite powder mixed in explosives are predetermined different depending on different explosives, later identification of explosives can be readily made by checking the mixed ferrite powder.

EXAMPLE 3

Ferric oxide ($Fe_2O_3$), barium carbonate ($BaCO_3$) and strontium carbonate ($SrCO_3$) were mixed with one another to meet the following formula:

$$XBaO.(1-X)SrO.5.6Fe_2O_3.$$

Where X was selected O (Sample A), 0.2 (Sample B), 0.8 (Sample C) or 1 (Sample D).

The mixture was sintered at 1220° C., and was milled to form ferrite powder of 1–3 μm particle size.

Resultant ferrite samples A-D were distinguished from one another and identified by X-ray quantitative analysis as shown in Table 2.

TABLE 2

| Sample | BaO | SrO |
|---|---|---|
| A | 0 wt. % | 9.6 wt. % |
| B | 3.0 | 7.3 |
| C | 10.8 | 2.0 |
| D | 14.2 | 0 |

Explosives having respective ferrite magnets of those samples A-D could be later identified by X-ray quantitative analysis.

EXAMPLE 4

Addition A of CaO and $SiO_2$, Addition B of CaO and $Al_2O_3$, addition C of $SiO_2$, and addition D of $Bi_2O_3$ were separately added into each of barium ferrite powder and strontium ferrite powder to form eight (8) samples. Each powder mixture of eight samples was sintered at 1220° C., and eight sample powders were obtained after milling the sintered bodies to powders of 1–3 μm particle size.

The eight samples were distinctly distinguished from one another by X-ray quantitative analysis, and were later identified by the same analysis.

The coating of each ferrite particle can be colored by adding any coloring agent thereinto if it is desired. As a result, the explosive having the ferrite powder coated with the colored coating is distinctly visible, and can be, therefore, readily detected and identified.

EXAMPLE 5

Astrazon orange G of 5 grams and acetic acid of 10 grams were inserted into a beaker and were dissolved in boiled water of 4 liters. Into the resultant dye bath, 100 grams of ferrite powder coated with polymethyl methacrylate, which was prepared by the same method as in Example 1, was inserted and was cleansed by water after boiled during 30 minutes. As a result, orange-colored ferrite powder was obtained. The resultant orange-colored ferrite powder was dispersed through ammonia gelatin dynamite similar to Eample 1. The dynamite was distinctly visible comparing dynamites which does not have such orange-colored ferrite powder.

According to this invention, since each ferrite magnet particle dispersed in an explosive is coated with a resin which is stable for explosive materials, the explosive is stable for a long storage. The use of coloring agent mixed with, or defused into, the resin coating enables distinction and identification of the explosive.

What is claimed is:

1. In an explosive having a relatively small amount of powdered ferrite magnet dispersed therethrough, the improvement comprising each particle of said powdered ferrite magnet coated with a resin coating which is stable for the explosive materials on the entire outer surface of each particle.

2. The improvement as claimed in claim 1, wherein said resin coating is made of at least one selected from methyl methacrylate resin, styrene resin, acrylonitril resin, butadiene resin, vinyl acetate resin, acrylic acid resin, methylacrylate resin, and other vinyl resin.

3. The improvement as claimed in claim 1, wherein said ferrite magnet is at least one of barium ferrite magnet, strontium ferrite magnet, lead ferrite magnet and calcium ferrite magnet.

4. The improvement as claimed in claim 1, wherein the mean particle diameter is 100 $\mu$m or less.

5. The improvement as claimed in claim 1, wherein the amount of said resin coated ferrite magnet which is mixed in the explosive is 30 wt.% or less.

6. The improvement as claimed in claim 1, wherein said resin coating includes a coloring agent.

7. The improvement as claimed in claim 1, wherein said resin coating is dyed by a dying agent.

8. The improvement as claimed in claim 1, wherein the amount and kind of said ferrite magnet are peculiarly specified to an explosive to enable the later identification of said explosive.

9. A powdered ferrite material which is used for a tracer mixed in an explosive comprising each ferrite magnet particle coated with a resin coating which is stable on the explosive material on the entire outer surface thereof.

10. An explosive having a relatively small amount of powdered ferrite material dispersed therethrough, each particle of said powdered ferrite material coted with a resin coating which is stable on the explosive material on the entire outer surface of each particle.

11. A method for producing an explosive having powdered ferrite magnet dispersed therethrough comprising:

preparing a ferrite powder and explosive material separately;

subjecting said ferrite powder to a coating treatment with a resin which is stable for the explosive material;

mixing said resin coated ferrite powder with said explosive material and kneading said mixture by a kneader;

forming a body having a desired shaped and wrapping said body by a wrapping paper to form an explosive cartridge; and loading said explosive cartridge in a magnetizing machine to magnetize said ferrite powder mixed in the explosive.

12. The method as claimed in claim 11, wherein said resin is at least one selected from methyl methacrylate resin, styrene resin, acrylonitrile resin, butadiene resin, vinyl acetate resin, acrylic acid resin, methacrylate resin, and the other vinyl resin.

13. The method as claimed in claim 11, wherein said ferrite powder is at least one of barium ferrite, strontium ferrite, lead ferrite and calcium ferrite.

14. The method as claimed in claim 11, wherein 30 wt.% of said resin coated ferrite powder is mixed with the balance of said explosive material powder.

* * * * *

UNITED STATES PATENT AND TRADEMARK OFFICE

CERTIFICATE OF CORRECTION

PATENT NO. : 4,363,678

DATED : December 14, 1982

INVENTOR(S) : NISHIMURA et al

It is certified that error appears in the above-identified patent and that said Letters Patent are hereby corrected as shown below:

Col. 1, line 25: change "cann" to--can--
Col. 1, line 59: change "judgemene" to--judgement--
Col. 1, line 67: change "podered" to--powdered--
Col. 2, line 8: change "innvention" to--invention--
Col. 2, line 18: change "paticle" to--particle--
Col. 2, line 21: change "whih" to--which--
Col. 2, line 23: between "ferrite" and "powder" insert --magnet dispersed therethrough is produced by preparing a ferrite--
Col. 2, line 28: between "then" and "wrapping" insert --wrapped by a--
Col. 3, line 6: correct "chie" to--chine--
Col. 3, line 29: change "owder" to--powder--
Col. 5, line 13: change "Eample" to--Example--
Col. 6, line 14: change "coted" to--coated--
Col. 6, line 28: change "shaped" to--shape--

Signed and Sealed this

Fourteenth Day of June 1983

[SEAL]

Attest:

DONALD J. QUIGG

Attesting Officer

Acting Commissioner of Patents and Trademarks

UNITED STATES PATENT AND TRADEMARK OFFICE

CERTIFICATE OF CORRECTION

PATENT NO. : 4,363,678
DATED : December 14,1982
INVENTOR(S) : NISHIMURA et al

It is certified that error appears in the above-identified patent and that said Letters Patent are hereby corrected as shown below:

On the title page: Assignees: list as follows:

--Tohoku Metal Industries, Ltd.,Sendai, Japan;
Taisei Corporation, Tokyo, Japan--

Signed and Sealed this

*Thirteenth* Day of *September 1983*

[SEAL]

*Attest:*

GERALD J. MOSSINGHOFF

*Attesting Officer*

*Commissioner of Patents and Trademarks*